US010508813B2

(12) United States Patent
Okazaki

(10) Patent No.: US 10,508,813 B2
(45) Date of Patent: Dec. 17, 2019

(54) GAS TURBINE COMBUSTOR CROSS FIRE TUBE ASSEMBLY WITH OPENING RESTRICTING MEMBER AND GUIDE PLATES

(71) Applicant: MITSUBISHI HITACHI POWER SYSTEMS, LTD., Yokohama (JP)

(72) Inventor: Hirofumi Okazaki, Yokohama (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 257 days.

(21) Appl. No.: 15/417,514

(22) Filed: Jan. 27, 2017

(65) Prior Publication Data

US 2017/0284680 A1 Oct. 5, 2017

(30) Foreign Application Priority Data

Mar. 29, 2016 (JP) ..... 2016-064972

(51) Int. Cl.
*F23R 3/48* (2006.01)

(52) U.S. Cl.
CPC ..... *F23R 3/48* (2013.01)

(58) Field of Classification Search
CPC ..... F23R 3/48
See application file for complete search history.

(56) References Cited

U.S. PATENT DOCUMENTS 2,525,207 A 10/1950 Clarke et al.
2,722,803 A * 11/1955 Travers ..... F23R 3/48 60/39.37

(Continued)

FOREIGN PATENT DOCUMENTS

CN 101446420 A 6/2009
GB 2443839 A 5/2008
JP H10-339440 A 12/1998

(Continued)

OTHER PUBLICATIONS

Russian Search Report dated May 7, 2018 for the Russian Patent Application No. 2017105389/06.

(Continued)

*Primary Examiner* — Lorne E Meade
*Assistant Examiner* — Stephanie Cheng
(74) *Attorney, Agent, or Firm* — Volpe and Koenig, P.C.

(57) ABSTRACT

A plurality of gas turbine combustors having a cross fire tube assembly that connects adjacent combustors. The combustors include combustion chambers having annular combustion air passages on outer peripheries thereof. The cross fire tube assembly has a dual pipe configuration including an inner tube that connects the combustion chambers of the adjacent combustors and an outer tube that covers therein the inner tube and connects the combustion air passages of the adjacent combustors. The cross fire tube assembly further has openings disposed between the inner tube and the outer tube of outer peripheral partition walls of the combustion air passages that are connected with the outer tube of the cross fire tube assembly centering on the inner tube. The openings allow combustion air to flow in areas upstream and downstream of the inner tube with respect to a flow of the combustion air flowing through the combustion air passages.

15 Claims, 6 Drawing Sheets

(56) References Cited

U.S. PATENT DOCUMENTS

| | | | | |
|---|---|---|---|---|
| 6,334,294 | B1 * | 1/2002 | Belsom | F23R 3/48 60/39.37 |
| 2009/0139241 | A1 | 6/2009 | Hirata et al. | |

FOREIGN PATENT DOCUMENTS

| | | | |
|---|---|---|---|
| JP | 2004-317008 | A | 11/2004 |
| RU | 145981 | U1 | 9/2014 |
| RU | 158517 | U1 | 1/2016 |

OTHER PUBLICATIONS

European Search Report for European Patent Application No. 17153026A dated Jul. 21, 2017.
Chinese Office Action dated Nov. 28, 2018 for the Chinese Patent Application No. 201710057566.1.
Indian Examination Report dated Aug. 16, 2019 for the Indian Patent Application No. 201714002541.

* cited by examiner

GAS TURBINE COMBUSTOR CROSS FIRE TUBE ASSEMBLY WITH OPENING RESTRICTING MEMBER AND GUIDE PLATES

CLAIM OF PRIORITY

The present application claims priority from Japanese Patent application serial No. 2016-64972, filed on Mar. 29, 2016, the content of which is hereby incorporated by reference into this application.

BACKGROUND OF THE INVENTION

1. Field of the Invention

The present invention relates generally to gas turbine combustors and, more specifically, to a gas turbine combustor suitable for a configuration including a plurality of combustors that burn a mixture of fuel and air, the combustors being connected with each other by a cross fire tube assembly.

2. Description of Related Art

One known type of gas turbine is a multi-can type that includes a plurality of gas turbine combustors (hereinafter referred to as combustors) in a single gas turbine. Generally, in the multi-can type gas turbine, the combustors are disposed annularly around the gas turbine. One or more of the combustors are provided with respective igniters, while the other combustors are not provided with respective igniters. The combustor having no igniter is ignited through a tube called a cross fire tube assembly that connects adjacent combustors. During starting of the gas turbine, the combustor having an igniter is first ignited and the adjacent combustors are ignited through the cross fire tube assemblies, so that all combustors are ignited.

The above-described cross fire tube assembly is typically configured as a dual pipe configuration including an inner tube and an outer tube. The inner tube connects combustion chambers of adjacent combustors. The inner tube allows combustion exhaust gases at high temperatures to flow therethrough, thereby achieving flame propagation. The outer tube is disposed on an outer peripheral side of the inner tube. The outer tube connects fuel air passages of the adjacent combustors and protects the inner tube.

The cross fire tube assembly constitutes an element necessary for the above-described ignition operation and is thus required to achieve reliable ignition. In addition, the cross fire tube assembly is exposed to combustion exhaust gases at high temperatures and thus requires proper consideration to be given for prevention of thermal deformation and fire damage. Moreover, consideration needs also to be given to, for example, an assembly method applicable to connecting the combustors and a technique for coping with possible deformation. Known techniques are described in, for example, JP-10-339440-A and JP-2004-317008-A.

JP-10-339440-A discloses a technique that prevents fire damage of the cross fire tube assembly by cooling. JP-2004-317008-A discloses a technique that prevents combustion air from flowing unevenly, which is caused by the cross fire tube assembly that hampers the combustion air flow.

It is noted that the cross fire tube assembly utilizes a pressure difference produced between a combustor in which combustion is completed and an adjacent combustor in which ignition is yet to occur to thereby cause combustion exhaust gases to flow into, and ignition to occur in, the combustor in which ignition is yet to occur. When there is no difference in an air amount, a fuel amount, and pressure among different combustors after ignition has been completed in all combustors, no difference in pressure exists among different combustors and the combustion exhaust gases no longer flow through the cross fire tube assemblies. In this case, the combustion exhaust gases at high temperatures flow through the cross fire tube assemblies for only a brief period of time during ignition. In reality, however, the air amount, fuel amount, pressure, and combustion status vary from one combustor to another.

As a result, a pressure difference is produced between adjacent combustors and the combustion exhaust gases at high temperatures may continue flowing through the cross fire tube assembly. At this time, an inner wall of the cross fire tube assembly, because of being continuously exposed to the combustion exhaust gases at high temperatures, is heated to high temperatures. Cooling is thus required for prevention of thermal deformation and fire damage of the cross fire tube assembly.

One known method for cooling the cross fire tube assembly introduces part of the combustion air into the cross fire tube assembly through an air hole formed in the cross fire tube assembly for the cooling. For the cross fire tube assembly having the dual pipe configuration, the foregoing method involves a wall surface of the inner tube being cooled by the combustion air in the outer tube when the combustion air is made to flow into the inner tube via the air hole formed in the wall of the inner tube.

For the cooling of the wall surface of the inner tube using the air hole formed in the wall of the inner tube, the inflow of air reduces temperatures of the combustion exhaust gases that flow through the inner tube of the cross fire tube assembly. Use of a plurality of air holes in order to increase an inflow of air, intended for cooling the wall surface of the inner tube, causes a combustion gas inside the inner tube of the cross fire tube assembly to be cooled. As a result, proper flame propagation may not be achieved during ignition. Thus, the number of air holes or the amount of inflow air is limited, so that the method of having the air hole may make it difficult to prevent thermal deformation and fire damage.

The combustor in the multi-can type gas turbine includes an annular combustion air passage disposed on an outer peripheral side of, and centering on, a combustion chamber that constitutes a combustion space. The cross fire tube assembly, which connects adjacent combustion chambers, traverses the combustion air passage. With the cross fire tube assembly having the dual pipe configuration, the inner tube of the cross fire tube assembly traverses the combustion air passage. At this time, the inner tube serves as an obstacle to the combustion air flow.

Air flow velocity is reduced at areas downstream of the inner tube with respect to the combustion air flow. A reduced air flow rate thus results and circumferential unevenness occurs in the combustion air that flows into the combustion chamber. As a result, fuel and combustion air are unevenly mixed with each other in the combustion chamber. Typically, lean fuel combustion in which the fuel amount is smaller than the air amount is used for combustion in the gas turbine. At this time, an increased ratio of fuel at a local spot increases a combustion temperature at that particular spot, thus increasing nitrogen oxide (NOx) emissions. In contrast, when a ratio of air increases at a local spot, combustion reaction does not progress due to a low combustion temperature and unburnt matter such as carbon monoxide tends to be produced. Thus, to enhance combustion performance, preferably, the fuel and the combustion air are uniformly mixed with each other, so that unevenness of the combustion air can be suppressed.

To suppress circumferential unevenness of the combustion air, the inner tube needs to have a reduced cross-sectional area to thereby reduce pressure loss in the combustion air flow. A reduced cross-sectional area of the inner tube, however, reduces the amount of combustion gases flowing through during ignition. As a result, proper flame propagation may be impaired.

The present invention has been made in view of the foregoing situation and it is an object of the present invention to provide a gas turbine combustor that cools a cross fire tube assembly without allowing a temperature of a combustion exhaust gas passing through the cross fire tube assembly to be reduced during ignition of the gas turbine combustor to thereby be able to prevent thermal deformation and fire damage of the cross fire tube assembly, and that suppresses circumferential unevenness of combustion air occurring in areas downstream of an inner tube of the cross fire tube assembly to thereby be able to reduce nitrogen oxide and unburnt matter such as carbon monoxide discharged from the gas turbine.

SUMMARY OF THE INVENTION

To achieve the foregoing object, the present invention provides a gas turbine combustor in a configuration including a plurality of combustors. Each combustor includes a combustion chamber having an annular combustion air passage on an outer periphery thereof. One combustor is connected with adjacent other combustor by a cross fire tube assembly. The adjacent other combustor is ignited by the cross fire tube assembly. The cross fire tube assembly has a dual pipe configuration including an inner tube, an outer tube, openings, and guide plates. The inner tube connects the combustion chambers of the adjacent combustors. The outer tube covers therein the inner tube and connects the combustion air passages of the adjacent combustors. The openings are disposed between the inner tube and the outer tube of outer peripheral partition walls of the combustion air passages that are connected with the outer tube of the cross fire tube assembly. The openings allow combustion air to flow in areas upstream and downstream of the inner tube with respect to the flow of the combustion air flowing through the combustion air passages centering on the inner tube. The guide plates are disposed upstream of the inner tube. The guide plates guide the combustion air into a space inside the outer tube via the opening.

According to the present invention, during ignition of the gas turbine combustor, the cross fire tube assembly is able to be cooled without allowing the temperature of the combustion exhaust gas that passes through the cross fire tube assembly to be reduced and prevents thermal deformation and fire damage of the cross fire tube assembly. Furthermore, unevenness of the combustion air that occurs in areas downstream of the inner tube of the cross fire tube assembly is able to be suppressed to thereby reduce nitrogen oxide and unburnt matter such as carbon monoxide discharged from the gas turbine.

DETAILED DESCRIPTION OF THE PREFERRED EMBODIMENTS

Figure 1:
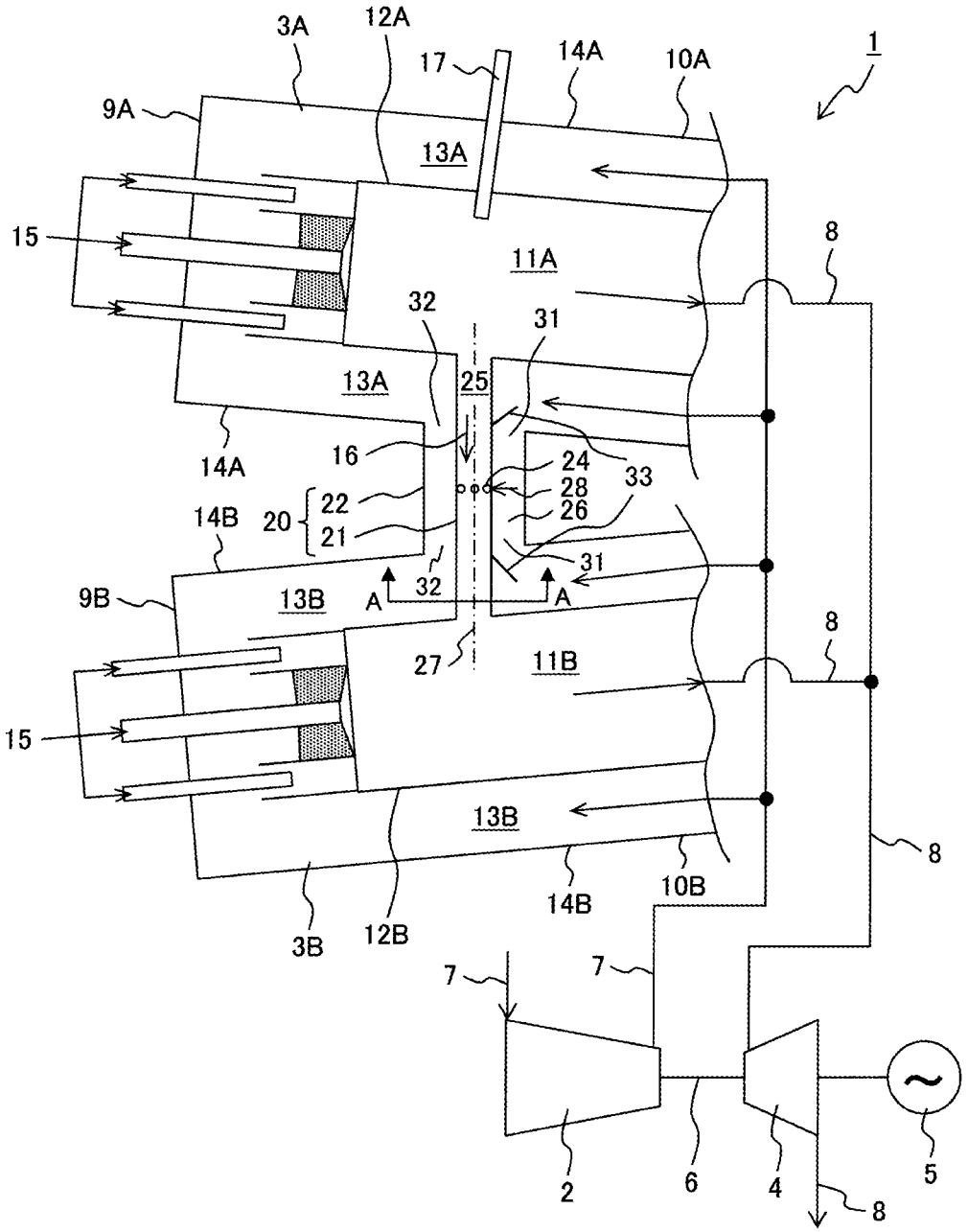
FIG. 1 is a schematic cross-sectional view showing a gas turbine combustor in a gas turbine that incorporates a gas turbine combustor according to a first embodiment of the present invention.

The following describes gas turbine combustors according to embodiments of the present invention as illustrated in the accompanying drawings. Like reference numerals refer to corresponding parts throughout the drawings.

First Embodiment

Figure 2:
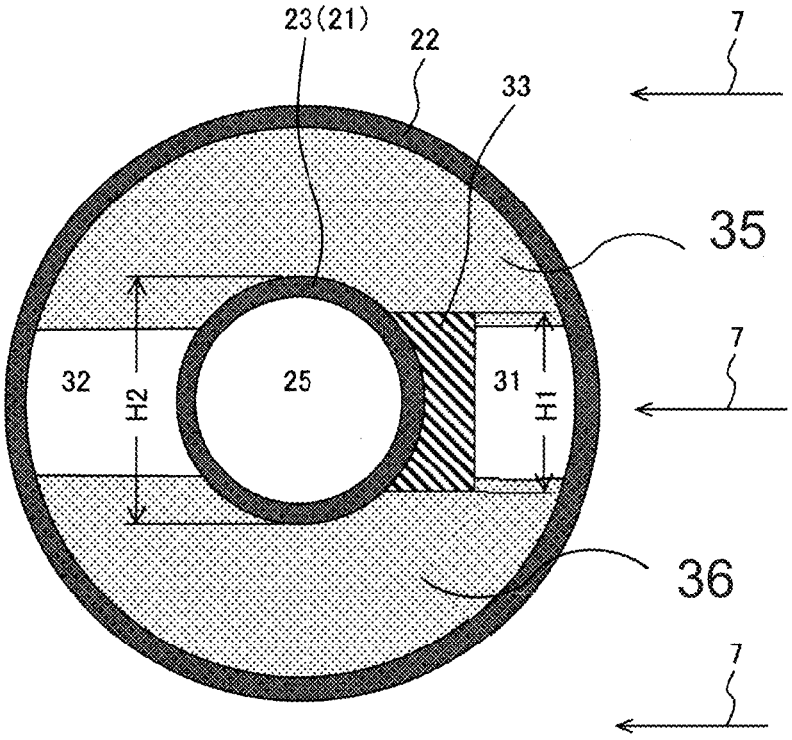
FIG. 2 is a cross-sectional view taken along line A-A in FIG. 1.
Figure 3:
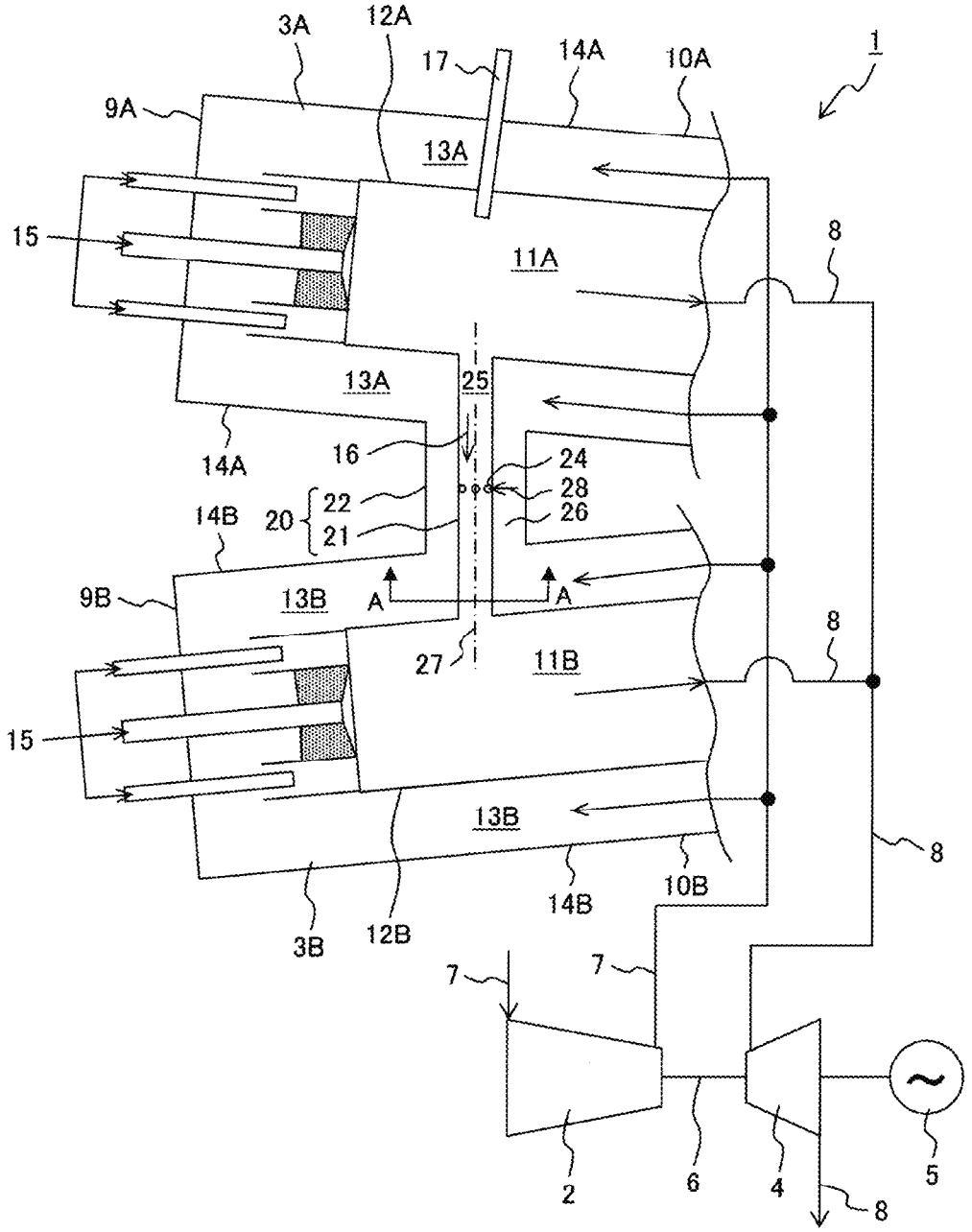
PRIOR ART FIG. 3
FIG. 3 is a schematic cross-sectional view showing a gas turbine combustor in a gas turbine that incorporates a conventional gas turbine combustor.
Figure 4:
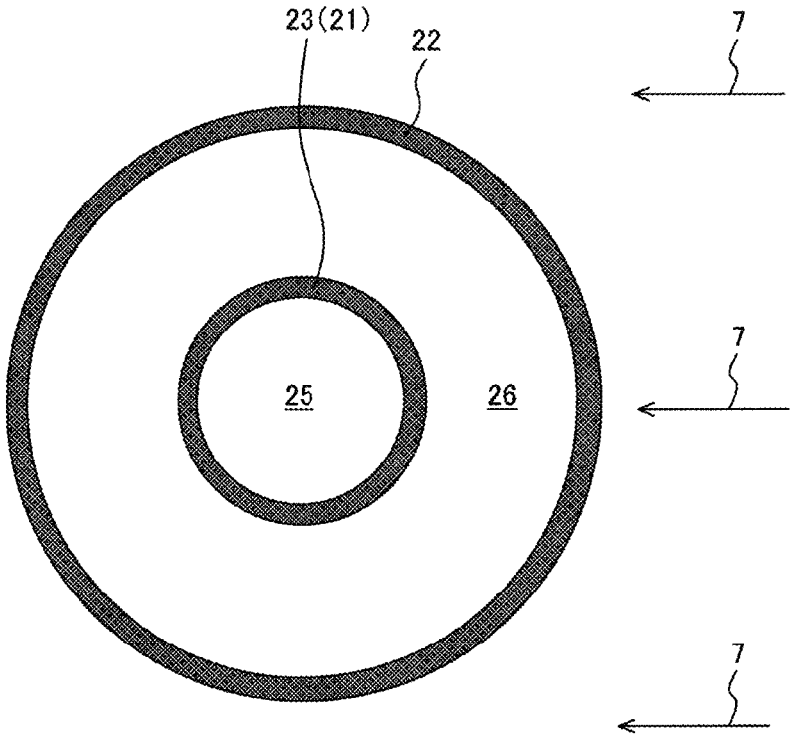
PRIOR ART FIG. 4
FIG. 4 is a cross-sectional view taken along line A-A in FIG. 3.

FIG. 1 shows a gas turbine that incorporates a gas turbine combustor according to a first embodiment of the present invention. FIG. 2 is a cross-sectional view taken along line A-A in FIG. 1. FIG. 3 shows a gas turbine that incorporates a conventional gas turbine combustor illustrated in comparison with the gas turbine combustor in the first embodiment shown in FIG. 1. FIG. 4 is a cross-sectional view taken along line A-A in FIG. 3.

Roles and tasks of a cross fire tube assembly for use in the gas turbine combustor according to the first embodiment of the present invention will first be described with reference to FIGS. 1 and 2. The gas turbine combustor according to the first embodiment of the present invention will then be described in comparison with the conventional gas turbine combustor shown in FIGS. 3 and 4.

As shown in FIG. 1, the gas turbine 1 includes a compressor 2, combustors 3A and 3B, a turbine 4, and a power generator 5. A drive shaft 6 connects the compressor 2, the turbine 4, and the power generator 5. Air (combustion air) 7 compressed by the compressor 2 is mixed with fuel 15 and burned by the combustors 3A and 3B. A combustion exhaust gas 8 at high temperature and high pressure is, as a result, produced. The gas turbine 1 then causes the turbine 4 to recover energy for generation of electric power using the power generator 5.

The combustors 3A and 3B have head portions (on the left-hand side in FIG. 1) 9A and 9B, respectively, disposed on the side adjacent to the compressor 2 and tail portions (on the right-hand side in FIG. 1) 10A and 10B, respectively, disposed on the side adjacent to the turbine 4. The combustors 3A and 3B includes combustion chambers 11A and 11B, partition walls (liners) 12A and 12B that constitute the combustion chambers 11A and 11B, combustion air passages 13A and 13B, and outer peripheral partition walls 14A and 14B, respectively, disposed in sequence from the center side to the outer peripheral side.

The combustion air 7 discharged from the compressor 2 flows from the tail portions 10A and 10B of the combustors 3A and 3B to pass through the combustion air passages 13A and 13B toward the head portions 9A and 9B of the combustors 3A and 3B. The combustion air 7 reverses a flow direction thereof at the head portions 9A and 9B of the combustors 3A and 3B and is mixed with the fuel 15 supplied from an external source to thereby be burned in the combustion chambers 11A and 11B. The combustion exhaust gas 8 flows from the tail portions 10A and 10B of the combustors 3A and 3B into and is discharged to the turbine 4.

It is noted that, although FIGS. 1 and 3 each illustrate two combustors for simplification of descriptions, the same descriptions apply to a configuration of three or more combustors. Although FIGS. 1 and 3 each show an arrangement in which the compressor 2, the turbine 4, and the power generator 5 are connected with each other by the single drive shaft 6, the drive shaft 6 may include a plurality of drive shafts divided. Additionally, the drive shaft 6 may be used for driving another rotational unit other than the power generator 5.

In the gas turbine 1 shown in FIG. 1 or 3, the combustor 3A is provided with an igniter 17 and a cross fire tube assembly 20 connects the combustors 3A and 3B. The cross fire tube assembly 20 has a dual pipe configuration including an inner tube 21 and an outer tube 22. The inner tube 21 of the cross fire tube assembly 20 is connected with the partition walls (liners) 12A and 12B of the combustion chambers 11A and 11B, respectively, through which a combustion exhaust gas 16 inside the combustion chambers 11A and 11B can flow. The outer tube 22 of the cross fire tube assembly 20 is connected with the outer peripheral partition walls 14A and 14B of the combustion air passages 13A and 13B, respectively, through which the combustion air 7 can flow.

During ignition of the gas turbine 1, the igniter 17 disposed at the combustor 3A ignites a mixture of the fuel 15 and air in the combustion chamber 11A. Pressure in the combustion chamber 11A, though building up through production of the combustion exhaust gas 8, still remains low because of the combustion chamber 11B being yet to be ignited. As a result, the combustion exhaust gas 16 is fed from the combustion chamber 11A into the combustion chamber 11B through the inner tube 21 of the cross fire tube assembly 20 that connects the combustion chambers 11A and 11B. In the combustion chamber 11B, the high-temperature combustion exhaust gas 16 that has flowed through the inner tube 21 of the cross fire tube assembly 20 ignites a mixture of the fuel 15 and air.

As described above, the combustors 3A and 3B that are adjacent to each other through the cross fire tube assembly 20 are ignited in sequence, so that all combustors involved can be ignited.

Given an air amount, a fuel flow rate, and pressure identical to each other among different combustors, no difference in pressure exists among the combustors when ignition is completed in all combustors. In this case, the combustion exhaust gas 16 at high temperature no longer flows through the inner tube 21 of the cross fire tube assembly 20 and the combustion exhaust gas 16 at high temperature flows through the inner tube 21 of the cross fire tube assembly 20 for only a brief period of time during ignition.

In reality, however, the air amount, the fuel flow rate, pressure, and the combustion status may vary from one combustor to another. In this case, because of the difference in pressure involved between the combustors 3A and 3B that are adjacent to each other, the combustion exhaust gas 16 at high temperature may continue flowing through the inner tube 21 of the cross fire tube assembly 20. A temperature of the inner tube 21 of the cross fire tube assembly 20 increases as a result of the combustion exhaust gas 16 at high temperature flowing therethrough, so that deformation or damage tends to occur in the inner tube 21 of the cross fire tube assembly 20 during an operation extending over a long period of time. The inner tube 21 of the cross fire tube assembly 20 needs to be cooled for prevention of deformation and damage.

The combustors 3A and 3B have the annular combustion air passages 13A and 13B on the outer peripheral side of the combustion chambers 11A and 11B, respectively. The cross fire tube assembly 20, which connects the combustion chambers 11A and 11B that are adjacent to each other, traverses the combustion air passages 13A and 13B. With the cross fire tube assembly 20 having the dual pipe configuration, the inner tube 21 of the cross fire tube assembly 20 traverses the combustion air passages 13A and 13B. At this time, the inner tube 21 of the cross fire tube assembly 20 serves as an obstacle to the flow of the combustion air 7. Thus, a reduced air velocity and a reduced air flow rate result in areas downstream of the inner tube 21 of the cross fire tube assembly 20 and circumferential unevenness occurs in the combustion air 7 that flows into the combustion chambers 11A and 11B. As a result, the fuel 15 and the combustion air 7 are unevenly mixed with each other in the combustion chambers 11A and 11B.

Typically, lean fuel combustion in which the amount of the fuel 15 is smaller than the air amount is used for combustion in the gas turbine 1. At this time, an increased ratio of the fuel 15 at a local spot increases a combustion temperature at that particular spot, thus increasing nitrogen oxide emissions. In contrast, when a ratio of air increases at a local spot, combustion reaction does not progress due to a low combustion temperature and unburnt matter such as carbon monoxide tends to be produced. Thus, to enhance combustion performance, preferably, the fuel 15 and the combustion air 7 are uniformly mixed with each other, so that unevenness of the combustion air 7 can be suppressed.

In the conventional gas turbine shown in FIGS. 3 and 4, a partition wall 23 that constitutes an inner tube 21 of a cross fire tube assembly 20 has air holes 24 formed therein. The air holes 24 are intended to achieve cooling of the inner tube 21 of the cross fire tube assembly 20. Namely, as shown in FIGS. 3 and 4, a space 26 on an outer peripheral side of the partition wall 23 that constitutes the inner tube 21 (disposed between the inner tube 21 and an outer tube 22) is connected with combustion air passages 13A and 13B. Additionally, a space 25 on an inner peripheral side of the partition wall 23 that constitutes the inner tube 21 is connected with combustion chambers 11A and 11B.

The foregoing arrangement results in pressure in the space 25 on the inner peripheral side of the partition wall 23 that constitutes the inner tube 21 being lower than pressure in the space 26 on the outer peripheral side of the partition wall 23. Thus, combustion air 7 that stagnates in the space 26 on the outer peripheral side flows through the air holes 24 formed in the partition wall 23 (inner tube 21) into the inner peripheral side as indicated by an arrow 28. The partition wall 23 that constitutes the inner tube 21 is cooled during this time.

Although the partition wall 23 of the inner tube 21 is cooled through the formation of the air holes 24 in the partition wall 23, the inflow of air reduces a temperature of a combustion exhaust gas 16 that flows through the inner tube 21 of the cross fire tube assembly 20. Forming a plurality of air holes 24, in particular, promotes cooling of the combustion exhaust gas 16 that flows through the inner tube 21, so that proper flame propagation from a combustor 3A to a combustor 3B can be hampered during ignition. Thus, the number and a cross-sectional area of air holes 24 formed in the partition wall 23, and the amount of inflow air are limited and the method of having the air holes 24 in the partition wall 23 may make it difficult to prevent thermal deformation and fire damage.

Another possible method for cooling the partition wall 23 of the inner tube 21 of the cross fire tube assembly 20 is to make the combustion air 7 flow through on the outer peripheral side of the inner tube 21, generally known as convective heat transfer.

In the multi-can type gas turbine 1, the combustors 3A and 3B are disposed such that the head portions 9A and 9B are spaced apart from each other. Because of the foregoing arrangement, an intersection angle formed between each of the combustion air passages 13A and 13B and a central axis 27 of the cross fire tube assembly 20 is slightly smaller than 90 degrees. As a result, the inner tube 21 of the cross fire tube assembly 20 is an obstacle to the combustion air 7. At a change in the flow direction of the combustion air 7, a flow away from the cross fire tube assembly 20 is formed, so that the combustion air 7 tends not to flow into the space 26 in the outer tube 22. Furthermore, when the combustors 3A and 3B are disposed such that an opening between the partition wall 23 (inner tube 21) and the outer tube 22 is formed annularly as in the conventional gas turbine shown in FIGS. 3 and 4, the combustion air 7 tends to flow in a distributed manner to the space 26 in the outer tube 22. In this case, the flow velocity near the partition wall 23 of the inner tube 21 of the cross fire tube assembly 20 is low, so that a heat dissipation amount is small through the convective heat transfer.

Additionally, in the conventional arrangement shown in FIGS. 3 and 4, the inner tube 21 of the cross fire tube assembly 20 traverses the combustion air passages 13A and 13B. Thus, a reduced air velocity and a reduced air flow rate result in areas downstream of the inner tube 21 of the cross fire tube assembly 20. Moreover, the tendency of the combustion air 7 toward being difficult to flow into the space 26 in the outer tube 22 of the cross fire tube assembly 20 causes circumferential unevenness to occur in the combustion air 7 that flows into the combustion chambers 11A and 11B.

Thus, the gas turbine combustor in the first embodiment of the present invention shown in FIGS. 1 and 2 is arranged to have openings 31 and 32 and to include guide plates 33. More specifically, the openings 31 and 32 are formed by opening restricting members 35 and 36 and are disposed at connections between the outer tube 22 of the cross fire tube assembly 20 and the outer peripheral partition walls 14A and 14B of the combustion air passages 13A and 13B, specifically, between the inner tube 21 and the outer tube 22 of the outer peripheral partition walls 14A and 14B of the combustion air passages 13A and 13B connected with the outer tube 22 of the cross fire tube assembly 20. The openings 31 and 32 allow the combustion air 7 to flow in areas upstream and downstream of the inner tube 21 with respect to the flow of the combustion air 7. The guide plates 33 are connected with the partition wall 23 of the inner tube 21 at positions near the opening 31 disposed upstream of the inner tube 21 of the cross fire tube assembly 20. The guide plates 33 are inclined toward the upstream side in the flow direction of the combustion air 7 so as to guide the combustion.

The foregoing arrangements, in which the openings 31 and 32 are disposed as described above at the connections between the outer tube 22 of the cross fire tube assembly 20 and the outer peripheral partition walls 14A and 14B of the combustion air passages 13A and 13B, enable the combustion air 7 to readily flow into the space 26 inside the outer tube 22. Additionally, the arrangements allow the combustion air 7 that has flowed into the inside of the outer tube 22 of the cross fire tube assembly 20 to readily flow along an outer surface of the inner tube 21 of the cross fire tube assembly 20.

The flow of the combustion air 7 in the gas turbine combustor according to the first embodiment will be described below.

The inner tube 21 of the cross fire tube assembly 20 is an obstacle to the combustion air 7 that flows through the combustion air passages 13A and 13B as described above. As a result, in the combustion air passages 13A and 13B, pressure is high in areas upstream of the inner tube 21 and low in areas downstream of the inner tube 21. The opening 31 disposed upstream of the inner tube 21 where the pressure is high causes the combustion air 7 to flow from the combustion air passage 13A into the space 26 inside the outer tube 22. The opening 32 disposed downstream of the inner tube 21 where the pressure is low causes the combustion air 7 inside the outer tube 22 to readily flow out to the combustion air passage 13B through the opening 32. Additionally, the guide plates 33 disposed upstream of the inner tube 21 so as to be inclined toward the upstream side in the flow direction of the combustion air 7 allow the combustion air 7 to readily flow into the inside of the outer tube 22 from the combustion air passage 13A.

In the arrangements of the cross fire tube assembly 20 according to the first embodiment, the combustion air 7 flows into the space inside the outer tube 22 through the opening 31 upstream of the inner tube 21 of the cross fire tube assembly 20 and is discharged from the opening 32 in the downstream. At this time, because of the openings 31 and 32 disposed near the inner tube 21, the combustion air 7 that has flowed into the space 26 inside the outer tube 22 flows along the outer surface of the inner tube 21.

As described above, restricting the openings 31 and 32 as compared with the conventional arrangement causes the flow velocity to increase on the outer surface of the inner tube 21 of the cross fire tube assembly 20. Thus, the combustion air 7 promotes convective heat transfer and cooling of the partition wall 23 that constitutes the inner tube 21 of the cross fire tube assembly 20. As a result, thermal deformation and fire damage of the inner tube 21 can be prevented.

The combustion air 7 that has flowed into the space 26 inside the outer tube 22 flows through the opening 32 to the area downstream of the inner tube 21 of the combustion air passage 13B. This increases the flow velocity of the combustion air 7 in an area near the opening 32 disposed downstream of the inner tube 21 of the cross fire tube assembly 20, so that an uneven flow of the combustion air 7 in the area downstream of the inner tube 21 can be suppressed. The suppression of the uneven flow enables combustion of a uniform mixture of the fuel 15 and air in the combustion chambers 11A and 11B, so that nitrogen oxide and unburnt matter such as carbon monoxide that are otherwise produced during uneven combustion can be reduced.

In the first embodiment, looking the cross fire tube assembly 20 shown in FIG. 1 from an axial direction thereof (from below upward in FIG. 1), preferably, a width (H1) of the guide plate 33 in a height direction is equal to or smaller than a width (H2) of the inner tube 21 in a height direction, as shown in FIG. 2. This is because of the following reason. Specifically, an increased width (H1) of the guide plate 33 in the height direction, while increasing the amount of inflow of the combustion air 7 into the space 26 inside the outer tube 22, adds to an obstacle to the flow of the combustion air 7, thus increasing pressure loss of the combustion air 7. However, the width (H1) of the guide plate 33 in the height direction being smaller than the width (H2) of the inner tube 21 in the height direction as in the first embodiment allows the pressure loss of the combustion air 7 to be reduced to an equivalent level to the pressure loss resulting from the inner tube 21, so that pressure loss as a result of having the guide plates 33 can be reduced. Furthermore, causing part of the combustion air 7 to flow into the space 26 inside the outer tube 22 may reduce pressure loss.

In the first embodiment as described above, the combustion air 7 is actively caused to flow into the inside of the outer tube 22 of the cross fire tube assembly 20 to thereby cause the combustion air 7 to flow around the inner tube 21. This arrangement allows the inner tube 21 to be cooled by convective heat transfer and suppresses an uneven flow in the combustion air passages 13A and 13B.

In the first embodiment, the openings 31 and 32, through which the combustion air 7 flows in, are disposed upstream and downstream of the flow of the combustion air 7 with respect to the inner tube 21, at the connections between the outer tube 22 and the combustion air passages 13A and 13B as described above.

This arrangement results in the inner tube 21 serving as an obstacle to the combustion air 7 that flows through the combustion air passages 13A and 13B, so that, in the combustion air passages 13A and 13B, pressure is high in areas upstream of the inner tube 21 and low in areas downstream of the inner tube 21. Having the openings 31 and 32, through which the combustion air 7 flows, on the upstream and downstream sides of the inner tube 21 makes the inner tube 21 an obstacle, so that the combustion air 7 tends more readily to flow into the inside of the outer tube 22. Namely, on the upstream side of the inner tube 21, the high pressure causes the combustion air 7 to tend to flow into the inside of the outer tube 22. On the downstream side of the inner tube 21, the low pressure causes the combustion air 7 inside the outer tube 22 to tend to be discharged. Additionally, the guide plates 33 that are inclined toward the upstream side in the flow direction of the combustion air 7 and disposed upstream of the inner tube 21 allow the combustion air 7 to tend to flow from the combustion air passages 13A and 13B into the inside of the outer tube 22.

Thus, in the cross fire tube assembly 20 incorporated in the gas turbine combustor according to the first embodiment, the combustion air 7 flows in the outer tube 22 through the opening 31 disposed upstream of the inner tube 21 and is discharged from the opening 32 disposed downstream of the inner tube 21. At this time, the openings 31 and 32 that are restricted to areas near the inner tube 21 allow the combustion air 7 that has flowed in the outer tube 22 to flow along the outer surface of the inner tube 21. Thus, heat is dissipated through convective heat transfer from the inner tube 21 toward the combustion air 7, so that the inner tube 21 can be cooled.

Unlike the first embodiment, the opening is not restricted at the connections between the outer tube 22 and the combustion air passages 13A and 13B in the conventional arrangement. As a result, when the opening is wide, the combustion air 7 tends to flow in a distributed manner in the outer tube 22, resulting in a low flow velocity of the combustion air 7 that flows along the outer surface of the inner tube 21. At this time, the low flow velocity of the combustion air 7 flowing along the outer surface of the inner tube 21 keeps heat dissipation by convective heat transfer low, causing the temperature of the inner tube 21 to increase.

By contrast, in the first embodiment, the guide plates 33 disposed near the opening 31 at an inlet portion so as to be inclined toward the upstream side in the flow direction of the combustion air 7 allow the combustion air 7 to readily flow into the inside of the outer tube 22. Restricting the openings 31 and 32 at the inlet and outlet to areas near the inner tube 21 increases the flow velocity of the combustion air 7 that flows along the outer surface of the inner tube 21 as compared with the flow velocity in the conventional arrangement, thus promoting cooling through convective heat transfer under a forced draft condition. As a result, thermal deformation and fire damage of the inner tube 21 can be prevented.

Returning the combustion air 7 that has flowed in the outer tube 22 from the downstream side of the inner tube 21 to the combustion air passage 13B results in an increased flow velocity of the combustion air 7 in areas downstream of the inner tube 21. Thus, the inner tube 21 is resistance to the flow of the combustion air 7 and a reduced flow velocity results. The supply of the combustion air 7 to the downstream side of the inner tube 21 by way of the outer tube 22 can, however, suppress the flow velocity from being reduced. The suppression of the reduction in the flow velocity enables combustion of a uniform mixture of the fuel 15 and air in the combustion chambers 11A and 11B, so that nitrogen oxide and unburnt matter such as carbon monoxide that are otherwise produced during uneven combustion can be reduced.

The arrangement of the first embodiment enables, during ignition of the gas turbine combustor, the cross fire tube assembly to be cooled without allowing the temperature of the combustion exhaust gas that passes through the cross fire tube assembly to be reduced and prevents thermal deformation and fire damage of the cross fire tube assembly. Furthermore, the arrangement of the first embodiment suppresses unevenness of the combustion air that occurs in areas downstream of the inner tube of the cross fire tube assembly to thereby be able to reduce nitrogen oxide and unburnt matter such as carbon monoxide discharged from the gas turbine.

Second Embodiment

Figure 5:
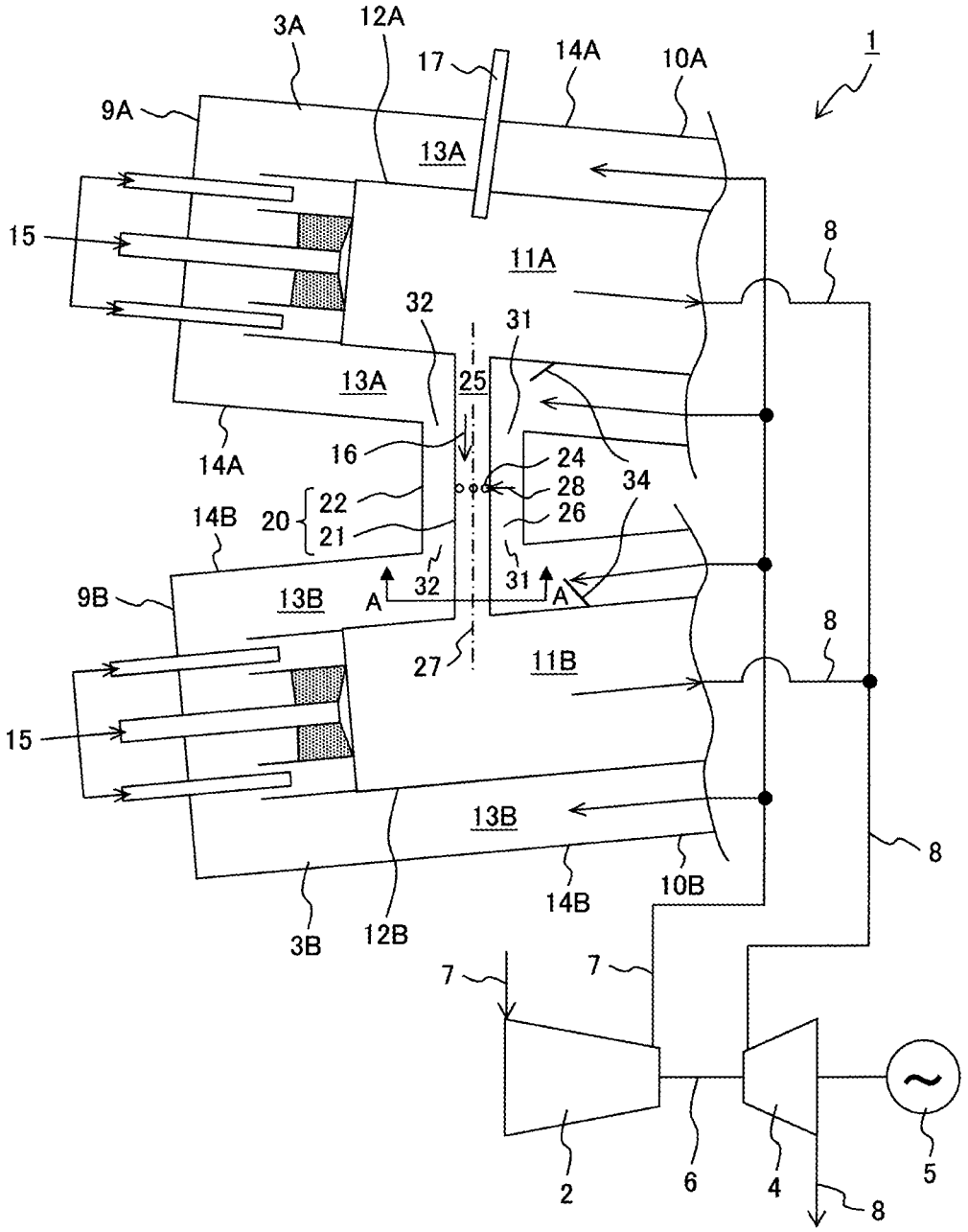
FIG. 5 is a schematic cross-sectional view showing a gas turbine combustor in a gas turbine that incorporates a gas turbine combustor according to a second embodiment of the present invention.

FIG. 5 shows a gas turbine that incorporates a gas turbine combustor according to a second embodiment of the present invention.

The gas turbine combustor in the first embodiment shown in FIGS. 1 and 2 includes the guide plates 33 disposed near the opening 31 so as to be inclined toward the upstream side in the flow direction of the combustion air 7. The gas turbine combustor in the second embodiment includes guide plates 34. As shown in FIG. 5, the guide plates 34 are disposed near an opening 31 and connected with partition walls (liners) 12A and 12B that isolate combustion air passages 13A and 13B from combustion chambers 11A and 11B, respectively. The guide plates 34 are inclined toward the downstream side in the flow direction of combustion air 7 inside the combustion air passages 13A and 13B. The gas turbine combustor in the second embodiment is otherwise arranged in a manner similar to the arrangements of the gas turbine combustor in the first embodiment.

The arrangements of the second embodiment as described above can achieve effects similar to the effects achieved by the first embodiment. It is noted that, with the second embodiment, preferably, the guide plates 34 are disposed at positions away from the inner tube 21 in order for the guide plates 34 to induce a flow toward the outer peripheral side to thereby allow the flow to be readily guided into the opening 31.

Third Embodiment

Figure 6:
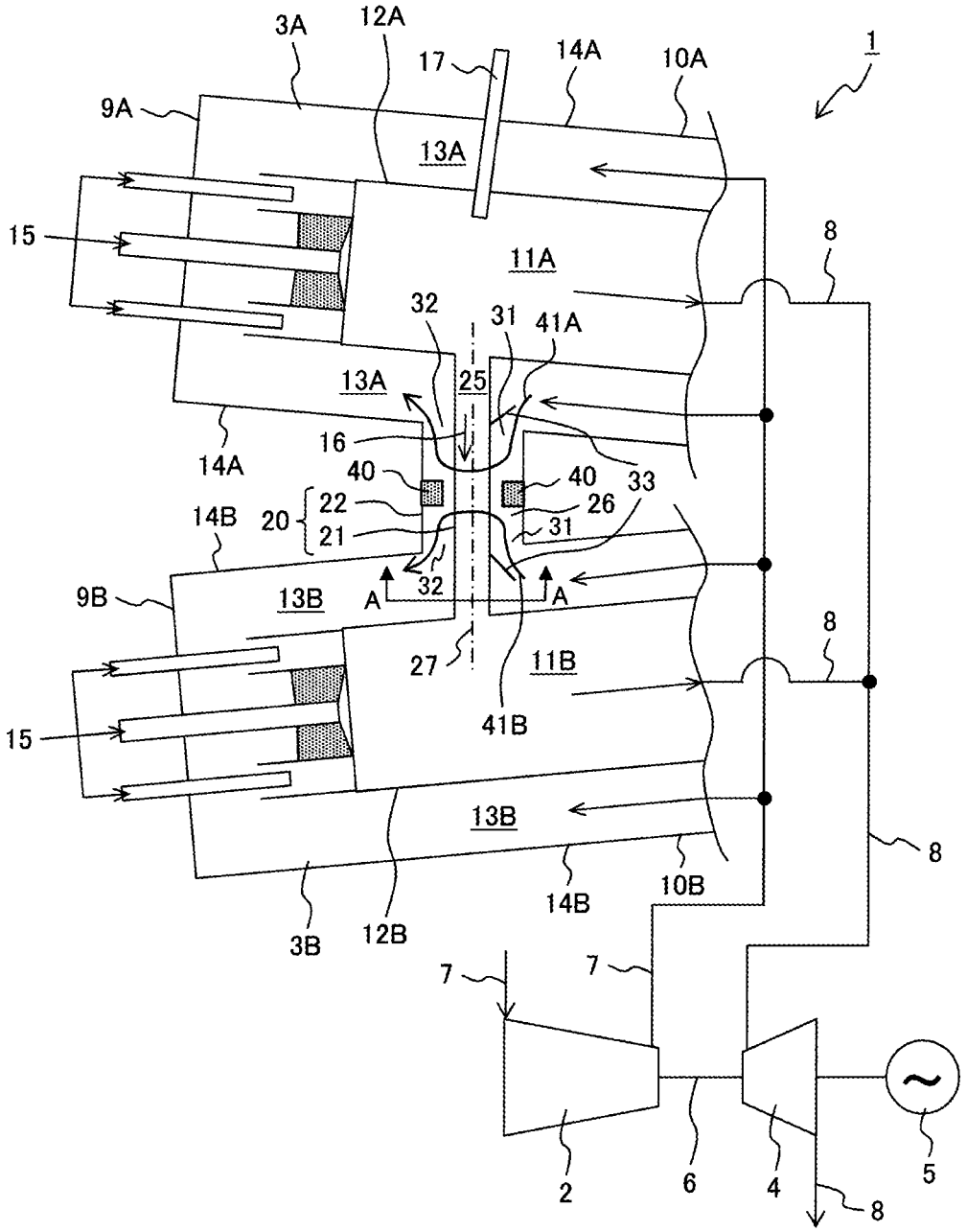
FIG. 6 is a schematic cross-sectional view showing a gas turbine combustor in a gas turbine that incorporates a gas turbine combustor according to a third embodiment of the present invention.

FIG. 6 shows a gas turbine combustor in a gas turbine that incorporates a gas turbine combustor according to a third embodiment of the present invention.

The gas turbine combustor according to the third embodiment includes, in addition to the elements of the first embodiment, a passage throttling member 40 that narrows a space 26 between an outer tube 22 and an inner tube 21 at a central portion in the axial direction of the outer tube 22. The passage throttling member 40 is formed of a cylindrical block. It is noted that the passage throttling member 40 of the third embodiment may be included in the arrangements of the second embodiment.

Understandably, the arrangements of the third embodiment as described above can achieve effects similar to the effects achieved by the first embodiment. In addition, the passage throttling member 40 narrows the space between the inner tube 21 and the outer tube 22 to thereby serve as resistance to the flow of combustion air 7, making the combustion air 7 hard to flow in areas between combustion air passages 13A and 13B.

In the first and second embodiments described above, the arrangement that allows the combustion air 7 to readily flow into the space 26 inside the outer tube 22 results in the combustion air 7 more readily flowing to another combustor via the outer tube 22 than in the conventional arrangement. The flow of the combustion air 7 to the other combustor results in a short supply of air relative to the fuel 15 in a source combustor. In contrast, the air amount increases relative to the amount of the fuel 15 in a destination combustor. Thus, the ratio of the fuel 15 to air varies from one combustor to another. As described previously, preferably, the fuel 15 and the air are uniformly mixed with each other for combustion in the combustors 3A and 3B of the gas turbine 1. Meanwhile, an increased ratio of the fuel 15 increases a combustion temperature of the combustors 3A and 3B to thereby increase nitrogen oxide emissions. In contrast, an increased ratio of air hampers combustion reaction due to a low combustion temperature involved of the combustors 3A and 3B, so that unburnt matter such as carbon monoxide tends to be produced.

The passage throttling member 40 in the third embodiment makes the combustion air 7 hard to flow in areas between the combustion air passages 13A and 13B. Thus, the combustion air 7 flows into the space 26 inside the outer tube 22 via an opening 31 on the upstream side. The combustion air 7 that has flowed in the outer tube 22 flows out to the combustion air passages 13A and 13B via an opening 32 on the downstream side. Namely, the combustion air 7 forms a flow indicated by arrows 41A and 41B. A flow of the combustion air 7 flowing along the surface of the inner tube 21 is reversed by the passage throttling member 40 and forms a circulating flow on each side of the openings 31 and 32. The circulation of air in the space 26 inside the outer tube 22 promotes convective heat transfer, thus expediting cooling of the inner tube 21.

It should be noted that the present invention is not limited to the above-described embodiments and may include various modifications. For example, the entire detailed configuration of the embodiments described above for ease of understanding of the present invention is not always necessary to embody the present invention. Part of the configuration of one embodiment may be replaced with the configuration of another embodiment, or the configuration of one embodiment may be combined with the configuration of another embodiment. The configuration of each embodiment may additionally include another configuration, or part of the configuration may be deleted or replaced with another.

REFERENCE SIGNS LIST

1: gas turbine
2: compressor
3A, 3B: combustor
4: turbine
5: power generator
6: drive shaft
7: combustion air
8, 16: combustion exhaust gas
9A, 9B: combustor head portion
10A, 10B: combustor tail portion
11A, 11B: combustion chamber
12A, 12B: partition wall (liner)
13A, 13B: combustion air passage
14A, 14B: outer peripheral partition wall of combustion air passage
15: fuel
17: igniter
20: cross fire tube assembly
21: inner tube of cross fire tube assembly
22: outer tube of cross fire tube assembly
23: partition wall of inner tube
24: air hole
25: space inside inner tube
26: space between inner tube and outer tube
27: central axis of cross fire tube assembly
31, 32: opening
33, 34: guide plate
40: passage throttling member
41A, 41B: arrow indicating a flow

What is claimed is:

1. A gas turbine combustor in a configuration having a plurality of combustors;

each combustor including an annular liner, a combustion chamber within the annular liner, an outer peripheral partition wall surrounding the annular liner, and an annular combustion air passage for a flow of combustion air, the annular combustion air passage defined between the outer peripheral partition wall and the annular liner;

one of the plurality of combustors being connected with another one of the plurality of combustors adjacent to the one of the plurality of combustors by a cross fire tube assembly, the another one of the plurality of combustors being ignited by the one of the plurality of combustors through the cross fire tube assembly, wherein:

the cross fire tube assembly has a dual pipe configuration including an inner tube that connects the combustion chamber of the one of the plurality of combustors with the combustion chamber of the another one of the plurality of combustors, an outer tube that covers therein the inner tube and is connected with the outer peripheral partition wall of the one of the plurality of combustors and the outer peripheral partition wall of the another of the plurality of combustors so as to connect the annular combustion air passage of the one of the plurality of combustors with the annular combustion air passage of the another one of the plurality of combustors, and an annular space defined between the inner tube and the outer tube;

an opening restricting member is provided at each respective connection between the outer tube and the respective annular combustion air passages of the one of the plurality of combustors and the another of the plurality of combustors to restrict the respective flow of combustion air therefrom into the annular space between the inner tube and the outer tube, each opening restricting member positioned in the annular space between the inner tube and the outer tube so as to form an upstream opening disposed upstream of the inner tube with respect to the respective flow of combustion air flowing through the respective annular combustion air passage and a downstream opening disposed downstream of the inner tube with respect to the respective flow of combustion air flowing through the respective annular combustion air passage, wherein the upstream opening and the downstream opening are separate and discrete openings; and guide plates are disposed upstream of the inner tube in each annular combustion air passage to guide the respective flow of combustion air from the respective annular combustion air passage into the annular space between the inner tube and the outer tube via the respective upstream opening.

2. The gas turbine combustor according to claim 1, wherein the guide plates are connected to the inner tube.

3. The gas turbine combustor according to claim 2, wherein the guide plates are disposed to be inclined from the inner tube toward an upstream side of the respective annular combustion air passage.

4. The gas turbine combustor according to claim 2, wherein, the cross fire tube assembly defines an axial direction along a longitudinal axis of the inner tube, and a height direction perpendicular to both the axial direction and the respective flows of combustion air in the respective annular combustion air passages; and looking at the cross fire tube assembly from the axial direction, a width of the guide plates in the height direction is equal to or smaller than a width of the inner tube in the height direction.

5. The gas turbine combustor according to claim 2, further comprising: a passage throttling member disposed at a central portion in an axial direction of the outer tube, the passage throttling member narrowing the annular space between the outer tube and the inner tube at the central portion.

6. The gas turbine combustor according to claim 1, wherein the guide plates are connected to the respective annular liner.

7. The gas turbine combustor according to claim 6, wherein the guide plates are disposed to be inclined toward a downstream side with respect to the respective flows of combustion air in the respective annular combustion air passages.

8. The gas turbine combustor according to claim 1, wherein, the cross fire tube assembly defines an axial direction along a longitudinal axis of the inner tube, and a height direction perpendicular to both the axial direction and the respective flows of combustion air in the respective annular combustion air passages; and looking at the cross fire tube assembly from the axial direction, a width of the guide plates in the height direction is equal to or smaller than a width of the inner tube in the height direction.

9. The gas turbine combustor according to claim 8, further comprising: a passage throttling member disposed at a central portion in an axial direction of the outer tube, the passage throttling member narrowing the annular space between the outer tube and the inner tube at the central portion.

10. The gas turbine combustor according to claim 1, further comprising: a passage throttling member disposed at a central portion in an axial direction of the outer tube, the passage throttling member narrowing the annular space between the outer tube and the inner tube at the central portion.

11. The gas turbine combustor according to claim 1, wherein pressure is higher in the upstream openings than in the downstream openings due to the inner tube crossing the respective annular combustion air passages of the one of the plurality of combustors and the another of the plurality of combustors, and the inner tube is disposed as an obstacle to the respective flows of combustion air therethrough.

12. The gas turbine combustor according to claim 2, wherein the guide plates are connected to the inner tube.

13. The gas turbine combustor according to claim 11, wherein the guide plates are connected to the respective annular liner.

14. The gas turbine combustor according to claim 11, wherein, the cross fire tube assembly defines an axial direction along a longitudinal axis of the inner tube, and a height direction perpendicular to both the axial direction and the respective flows of combustion air in the respective annular combustion air passages; and looking at the cross fire tube assembly from the axial direction, a width of the guide plates in the height direction is equal to or smaller than a width of the inner tube in the height direction.

15. The gas turbine combustor according to claim 11, further comprising: a passage throttling member disposed at a central portion in an axial direction of the outer tube, the passage throttling member narrowing the annular space between the outer tube and the inner tube at the central portion.

* * * * *